United States Patent [19]

Brown

[11] 4,413,430

[45] Nov. 8, 1983

[54] SKATE BOOT INSERT

[76] Inventor: Dennis N. Brown, 1091 Fir Ave., Blaine, Wash. 98230

[21] Appl. No.: 316,721

[22] Filed: Oct. 30, 1981

[51] Int. Cl.[3] ..... A43B 13/38; A43B 7/22; A43B 5/04

[52] U.S. Cl. ..... 36/44; 36/91; 36/115

[58] Field of Search ..... 36/44, 91, 92, 93, 114, 36/115, 43

[56] References Cited

U.S. PATENT DOCUMENTS

| | | | |
|---|---|---|---|
| 1,872,987 | 8/1932 | Langer | 36/43 |
| 2,660,814 | 12/1953 | Ritchey . | |
| 2,671,277 | 3/1954 | Montgomery | 36/44 X |
| 2,680,919 | 6/1954 | Riggs . | |
| 3,118,153 | 1/1964 | Hood . | |
| 3,624,930 | 12/1971 | Johnson et al. | 36/43 |
| 3,638,336 | 1/1972 | Silverman . | |
| 3,922,801 | 12/1975 | Zente . | |
| 3,981,602 | 9/1976 | Ogden . | |
| 4,054,706 | 10/1977 | Shapiro | 36/44 X |
| 4,167,824 | 9/1979 | Wolpa | 36/44 |

FOREIGN PATENT DOCUMENTS

| | | |
|---|---|---|
| 1240066 | 7/1960 | France . |
| 465940 | 5/1937 | United Kingdom . |

*Primary Examiner*—Richard J. Scanlan, Jr.
*Attorney, Agent, or Firm*—Blair, Brown & Kreten

[57] ABSTRACT

An insert for use in ice skates and the like which includes a blank having a top layer with an upper surface provided with a contour substantially complemental to the plantar surface of a person's foot, the top layer formed from a suitable material to resist abrasion, and absorb perspiration. The top layer is bonded to an intermediate layer formed of resilient material, a bottom portion of the intermediate surface affixed to a lower surface having a bottom layer provided with an alignment device for registry with the center line of a skate whereby deformation of the blank occurs along its longitudinal axis thereof, directly above the skate blade, the deformation of the blank causing a cradling and supporting effect upon the foot disposed within the skate so as to provide not only better centering over the skate blade, but also an improved load transmission from the foot through the leg resulting in overall better balance and skate edge control.

17 Claims, 4 Drawing Figures

FIG 1
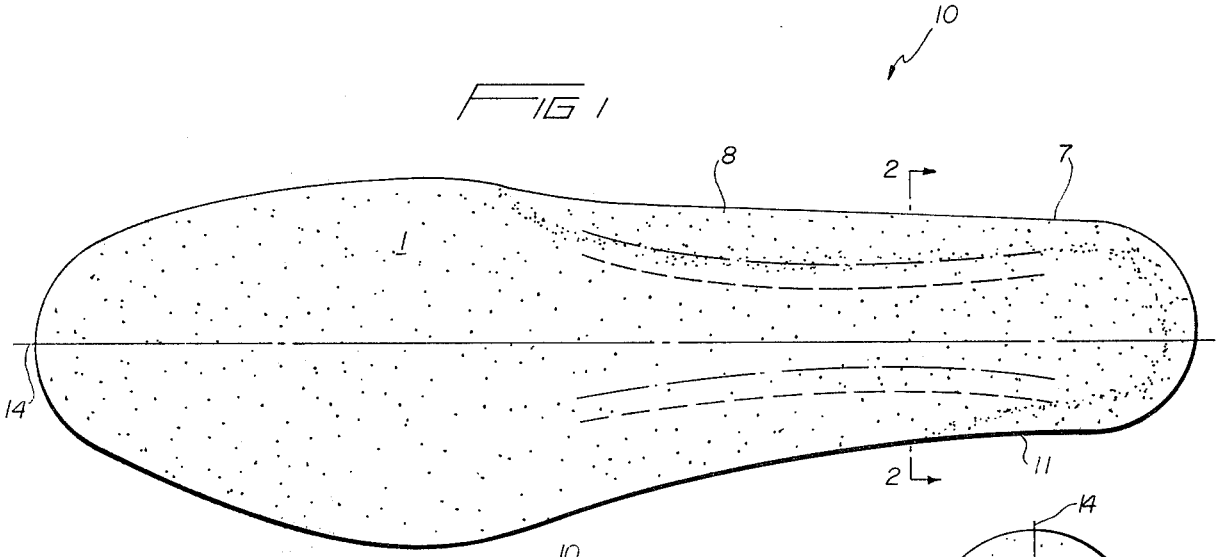
FIG 2
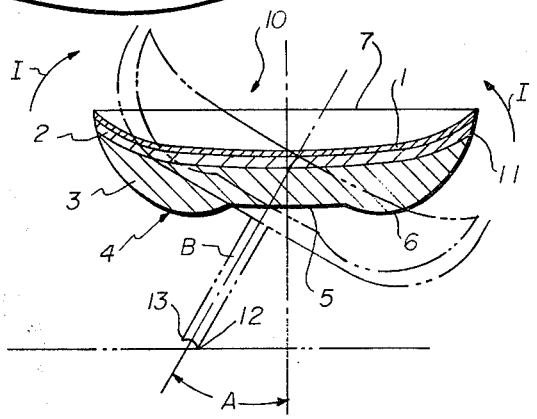
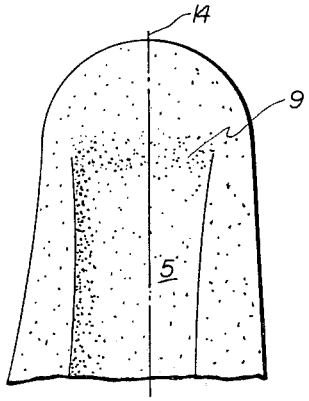
FIG 4
FIG 3
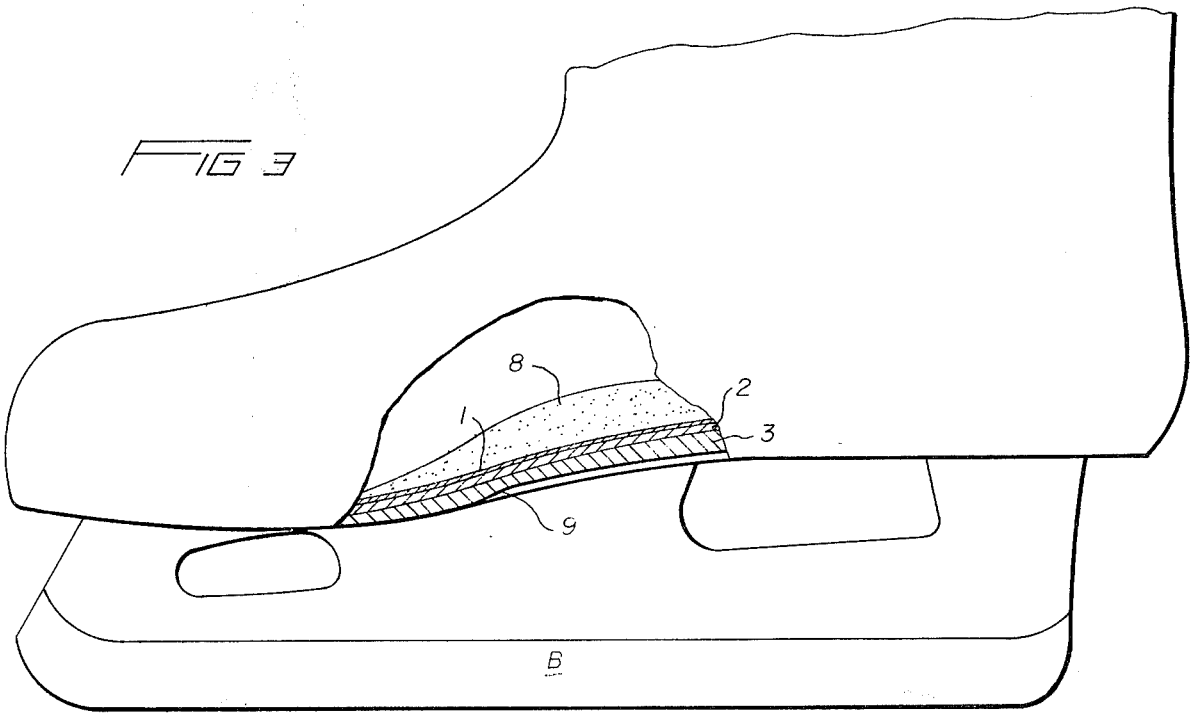

SKATE BOOT INSERT

BACKGROUND OF THE INVENTION

This invention relates generally to sock liners for ice skates or the like.

For a skater to perform with maximum efficiency and power, it is recommended that his feet be aligned correctly inside his skates. Prior art devices heretofore have provided a flat inner liner with nothing to position it correctly or keep it from moving inside the skate, and consequently the foot associated therewith would be capable of translation along the longitudinal or lateral axis within the boot. Centering of the foot over the blade is of critical importance in skating, since the power and control transmitted through the skates is determined solely by the way one stands over one's skate blades. For maximum performance one's feet must be aligned correctly within his skates and over the blade.

In an attempt to accurately transmit forces from the leg through the foot and onward to the blade of the skater, it has previously been thought necessary to tighten the boot excessively so as to increase the response between the foot and the blade, by eliminating clearances within the boot itself through deforming the boot and in many cases the foot. Thus, when the foot flattens because of such deformation, the foot and its relationship to the leg through the ankle leads to improper alignment causing instability, loss of power, loss of blood circulation and poor edge control. In addition, such improper alignment can be transferred further upward to the knee area and even the hip resulting in some cases in unnecessary injuries.

The following patents represent the state of the art in which applicant is aware in so far these references appear to be germane to the patent process. U.S. Pat. Nos. 2,660,814 Ritchey 2,680,919 Riggs 3,118,153 Hood 3,638,336 Silverman 3,922,801 Zente 3,981,602 Ogden 4,017,656 Lasman et al. 4,055,699 Hsiung 4,187,621 Cohen French Patent No. 1.240,066 Strasbach U.K. Patent No. 465,940.

Each of these references can be characterized in providing an orthopedic applicance relegated to general use such as walking or the like, and accordingly, the configurations of these applicances reflect the general nature of their utility.

By way of contrast, the instant application is directed to and claims an insert for an ice skate or the like in which proper foot support is provided and correct alignment of the foot with the blade is obtained not only assuring excellent load transfer from the foot through the ankle and upwards of the leg, but also balancing the rear foot and forefoot to the blade for best alignment and control. A well defined heel cup eliminates problems associated with weak ankles. By having this correct alignment, one obtains better edge control for more efficiency and greater power in skating. Moreover, the apparatus according to the instant invention provides not only an improved support for the foot, but constrains the foot from front-to-back and side-to-side translation thereby providing correct horizontal and longitudinal alignment relative to the skate blade for the benefits associated therewith. With the foot thusly disposed within a skate, the proper force transmission from the foot through the ankle and up the leg beyond the knee is possible, which reduces the amount of compensation required by other body components so as to minimize the incidents of injury to other areas which attempt to overcompensate for deficiencies in the boot.

SUMMARY AND OBJECTS OF THE INVENTION

Accordingly, this invention has as an object the provision of an improved insert specifically designed for use with ice skates or the like in which foot alignment along the longitudinal and lateral axis of the skate blade is of primary importance.

It is still a further object of this invention to provide a device of the character described above which is configured with an improved heel cup and calcaneal area whereby the insert itself provides controlled self deformation causing the foot to remain in alignment directly over the longitudinal axis of the blade, thereby retarding foot or insert translation along the longitudinal axis and laterally thereof.

It is still yet a further object of this invention to provide a device of the character described above which is relatively inexpensive to manufacture, extremely durable in construction, and lends itself to mass production techniques.

It is still yet a further object of this invention to provide a device of the character described above which eliminates clearance that exists in prior art devices between the foot and the boot, so that the boot does not have to be as tightly secured as in the prior art, thereby allowing the inter-action of the plural bones within the foot to continue upon a normal course, thereby reducing the likelihood of injury to other body parts caused by overcompensating for a deformed flattened foot.

These and other objects will be made manifest when considering the following detailed specification when taken in conjunction with the accompanying drawing figures.

BRIEF DESCRIPTION OF THE DRAWING FIGURES

FIG. 1 is a top plan view of the apparatus according to the present invention;

FIG. 2 is a sectional view taken along lines 2—2 of FIG. 1;

FIG. 3 is a side view of the insert disposed in its intended environment, within an ice skate; and FIG. 4 is a bottom plan view of a portion of that which is shown in FIG. 1.

DESCRIPTION OF THE PREFERRED EMBODIMENT

Referring to the drawings now, wherein like reference numerals refer to like parts throughout the various drawing figures, reference numeral 10 is directed to the ice skate insert according to the present invention.

The ice skate insert is defined by a blank 10 having a top layer 1 suitably formed from nylon, dacron, felt, cloth, or a synthetic fabric which is durable yet sufficiently porous to absorb prespiration, and is provided with an underlying resilient pad defining an intermediate layer 2, preferably formed from neoprene, rubber, sponge or the like; and is further provided with a lower layer 3 which is formed from a foamed material such as Freelen Tm, Plastizote Tm, or any of a number of open or closed cell foams characterized as being relatively resilient, having sufficient memory to return to its original state when unstressed, and capable of moderate shock absorption loads.

Each strata (i.e. top, intermediate and lower layers) is relatively affixed to the adjacent strata by any suitable technique, such as adhesion or fusion, so as to provide a reliable bond between the plural surfaces.

The lower layer 3 includes a bottom face 4 having a complex contour, which shall now be defined.

The area forward of the metatarsal area is substantially of uniform thickness from the bottom surface through the top surface, having a generally upwardly curved or bowed configuration complemental to the contour of the foot, and a thickened arch support area 8 suitably raised to abut against the arch of the user, and a portion extending from the metatarsal head to the calcaneal region provided with a recess 5 shown as dash lines directed along the longitudinal extent of the blank defining the insert 10, the recess defining a central longitudinal line 14 which is to be substantially co-planar with a skate blade. The recess 5, especially when the insert 10 is to be used in conjunction with figure skates, may preferably be offset, as shown by the dash-dot lines to one side or the other of the plane defined by the skate blade.

Different forms of ice skating require different edging techniques. Figure skating requires constant and quick transition from inner to outer edges 12, 13. Hockey skating primarily uses the inner edge 12. Therefore, the recess 5 is suitably configured so that a central longitudinal line of the recess can be either directly over the edge of the skate blade or offset to either side to provide varying insert deformation characteristics. The leading and trailing edges 9 of the recess, proximate to the metatarsal area and a terminal portion of the calcaneal area, is provided with a feathered or gradually tapering slope, so that there is a gradual transition at the metatarsal head area which thereby provides a highly desired uniform low force distribution coming up from the blade, through the boot and onto the foot of the user and thence to the leg.

Areas along the longitudinal extent, on either side of the recess are provided with arcuate section 6 which migrate upwardly and outwardly and terminate at the top surface area.

As shown in the drawings, the heel area of the foot is surrounded by an upwardly extending lip 7 (showing in FIG. 2), formed from all three layers which define the surface 11 coextensive along the top of the lip. Thus, in combination with the recess, deformation of the insert 10 is most likely to occur along the longitudinal blade axis coincident with the recess, causing a bowing of the insert in accordance with the direction of the arrows I, the net effect being that the lip 7 grasps and secures the heel of the user with greater force than the prior art devices would suggest. Moreover, having the recess 5 be of a width substantially greater than the blade B promotes beneficial deformation under both light and heavy loads in such a manner that the heel gripping effect is evident as soon as the skate is placed on the foot and increases or decreases in proportion to the load placed on the insert. Thus, when the insert is angulated such as angle A as shown in FIG. 2, the blade edge will be addressing the ice in a non perpendicular manner, but the weight distribution, into the boot and into the insert will always be dissipated and counteracted by a varying and shifting deformation of the lip 7, so as to compensate for the angulation by providing greater deformation of the insert in the proscribed opposed direction. Most specifically, the angle A will cause the weight of the user to migrate to the lowermost rounded portion 6, the resulting increased load at that point will cause a greater deformation proximate to the recess at that area, which will provide a turning moment along the lower lip proximate to the lowermost curved portion allowing a more vigorous resistance to the angulation by the lowermost portion of lip 7. By having the lip 7 formed from all 3 layers, the lip exhibits the composite characteristics of the entire insert.

Moreover, having thus described the invention, it should be apparent that numerous structural modifications are contemplated as being part of this invention as set forth hereinabove and defined by hereinbelow by the claims.

What I claim is:

1. An insert adapted for insertion and wearing use within a boot or the like, comprising in combination;

a blank having a top layer with its upper surface generally contoured to conform to the plantar surface of a person's foot, a lower layer having a bottom face provided with a recess substantially extending rearwardly from the metatarsal to the calcaneal area of the foot, the metatarsal area itself of uniform thickness along an entire metatarsal head area and transverse to said recess.

2. The device of claim 1 in which said recess is provided with feathered leading and trailing edges proximate to the metatarsal and calcaneal areas respectively.

3. The device of claim 2 in which marginal portions are provided on lateral sides of said recess.

4. The device of claim 3 in which said marginal portions have a curved contour, extending upwardly to said upper surface.

5. The device of claim 4 in which a peripheral lip extends around the heel calcaneal area of the foot, tapering toward the metatarsal area of the insert whereby deformation of said recess provides corresponding deformation of said lip to grasp more tightly the heel of the foot.

6. The device of claim 5 wherein an intermediate layer is provided between said top and lower layers said intermediate layer formed of a resilient material.

7. The device of claim 6 in which said lower layer is formed from a foam material having a memory and damping properties.

8. The device of claim 7 in which said top layer is formed from an abrasion resistant and absorbent material.

9. An insert adapted for insertion within an ice skate or the like, comprising in combination:

a blank having a top layer with its upper surface generally contoured to conform to the plantar surface of a person's foot, a lower layer having a bottom face provided with a recess substantially extending from the metatarsal to the calcaneal area of the foot, said recess centrally disposed over a blade of the ice skate in which said recess is provided with feathered leading and trailing edges proximate to the metatarsal and calcaneal areas respectively.

10. The device of claim 9 in which marginal portions are provided on lateral sides of said recess.

11. The device of claim 9 in which said marginal portions have a curved contour, extending upwardly to said upper surface.

12. The device of claim 9 in which a peripheral lip extends around the heel calcaneal area of the foot, tapering toward the metatarsal area of the insert whereby deformation of said recess provides corresponding deformation of said lip to grasp more tightly the heel of the foot.

13. The device of claim 9 wherein an intermediate layer is provided between said top and lower layers said intermediate layer formed of a resilient material.

14. The device of claim 9 in which said lower layer is formed from a foam material having a memory and damping properties.

15. The device of claim 9 in which said top layer is formed from an abrasion resistant and absorbent material.

16. The device of claim 9 in which said recess is configured to define a central longitudinal line which is to be substantially co-planar with the blade of the skate.

17. The device claim 9 in which said recess is configured to be offset laterally with respect to the blade of the skate.

* * * * *